United States Patent [19]

Nonnenmann

[11] Patent Number: 4,665,051

[45] Date of Patent: May 12, 1987

[54] CARRIER MATRIX FOR A CATALYTIC REACTOR FOR THE PURIFICATION OF EXHAUST GAS

[75] Inventor: Manfred Nonnenmann, Schwieberdingen, Fed. Rep. of Germany

[73] Assignee: Sueddeutsche Kuehlerfabrik Julius Fr. Behr GmbH & Co. KG, Fed. Rep. of Germany

[21] Appl. No.: 812,510

[22] Filed: Dec. 23, 1985

[30] Foreign Application Priority Data

Dec. 29, 1984 [DE] Fed. Rep. of Germany ... 8438260[U]

[51] Int. Cl.[4] ..... B01J 35/04

[52] U.S. Cl. ..... 502/439; 502/527; 422/180

[58] Field of Search ..... 502/439, 527; 422/180; 428/184, 186

[56] References Cited

U.S. PATENT DOCUMENTS 3,083,662 4/1963 Zeidler ..... 113/113
4,162,993 7/1979 Retallick ..... 252/477 R
4,220,625 9/1980 Toh et al. ..... 502/527 X
4,300,956 11/1981 Rosenberger et al. ..... 502/527 X

FOREIGN PATENT DOCUMENTS 2815317 10/1979 Fed. Rep. of Germany .

*Primary Examiner*—W. J. Shine
*Attorney, Agent, or Firm*—Barnes & Thornburg

[57] ABSTRACT

A carrier matrix for a catalytic reactor for the purification of the exhaust gas of internal combustion engines, comprising a flat foil and a corrugated foil arranged in alternating layers. Exhaust gas flows through the ducts formed by the corrugations of the corrugated foil and the flat foil surface. The corrugations have a plurality of segments fluidly connected behind one another in flow direction, but are transversely staggered with respect to flow direction. This staggered arrangement increases the turbulence of the gas flowing through the ducts, thereby increasing the effectiveness of the matrix. The matrix can be manufactured in a simple manner yet permits a good utilization of the catalyst materials coated on the foils.

8 Claims, 2 Drawing Figures

CARRIER MATRIX FOR A CATALYTIC REACTOR FOR THE PURIFICATION OF EXHAUST GAS

BACKGROUND AND SUMMARY OF THE INVENTION

This invention relates to a carrier matrix in particular for a catalytic reactor for the purification of the exhaust gas of internal combustion engines.

It is shown by German Patent DE-OS No. 29 02 779 to make a matrix of different foils for a catalytic reactor for purifying exhaust gas by rolling up the foils. Smooth metal foils and corrugated metal strips are alternately placed against one another and rolled up together. Subsequently, these metal foils are soldered. In a further work step, they are coated with a catalyst material. The corrugated strips between the smooth foils, in a matrix of this type, form passage ducts for the exhaust gas, which by means of slanting several corrugated strips arranged behind one another, the turbulence of the exhaust gases flowing through can be also increased in the area between two smooth foils.

It is shown in German Patent DE-PS No. 27 33 640 to make the smooth metal foils with stamped-out areas or projections which engage into openings in the corrugated foil, and hook together during the layering or rolling-up, so that relative sliding of the individual layers is avoided. As a result, under certain circumstances, a soldering process is unnecessary. It is a disadvantage of this arrangement that during the rolling-up or the layering, the layers that are to be applied on top of one another must be mutually aligned, making the manufacturing process costly. Also, it cannot be ensured in all cases that the individual layers in each matrix are placed on top of one another in the same way. The result may be that in different carrier matrices, catalyst surfaces exist that have a different effect on the exhaust gas, which is undesirable with respect to the utilization of the catalyst material.

A further disadvantage is that catalyst bodies made in this way, although causing an increase in turbulence within the individual flow-through ducts bordered by the flat metal foils, allow almost no gas compensation to take place in radial direction which, with respect to a utilization of the catalyst material, is also undesirable. It was suggested in German Patent DE-PS No. 33 47 086.3 to layer metal foils directly on top of one another, in the manner of turbulence plates as they are used in heat exchangers. However, such types of construction, with respect to manufacturing technology, have certain disadvantages.

An objective of the present invention is to avoid these disadvantages by creating a carrier matrix of the initially mentioned type which permits a good utilization of the catalyst materials combined with a simple manufacturing method.

This and other objectives are achieved by providing a carrier matrix with a flat foil and a corrugated foil, arranged as alternating layers. The corrugated foil has a plurality of corrugations, with each corrugation having a plurality of segments fluidly connected behind one another in air flow direction, and transversely staggered to each other with respect to the air flow direction.

The foils of the present invention can be placed on top of one another in a simple manner regardless of the shape of the corrugations or the profile of the corrugations. The foils are excellently suited for the making of wound carrier matrices because the continuous flat metal foil can absorb the tensile stress exercised during the rolling-up of the foils, while the corrugated segments, because of their continuous contacting arrangement with the flat strip over the entire width of the flat strip, also cannot be deformed during the winding process in an undesirable manner. This is because the corrugated metal segments of the present invention have a high inherent stability.

Despite the use of a continuous flat foil, a radial gas compensation in the carrier matrix body can be achieved in a relatively simple manner between the individual layers or windings by providing openings in the flat foil. In this manner, a connection can be established between the flow duct segments of foils disposed above one another. Also, the flow duct segments that laterally border on one another formed by the corrugations are connected with one another so that a good gas compensation is achieved during the flow-through. Finally, especially preferred embodiments provide corrugated segments which have corrugations with a trapezoidal cross-section which are arranged such that the smaller of the two parallel sides of the trapezoid forms the side that is closed by the corrugated strip, while the larger of the sides forms the open side of the corrugated strip. This trapezoidal cross-section results in a very good stability of the corrugated strip which is significant for the winding-up of the matrix.

Further objects, features and advantages of the present invention will become more apparent from the following description when taken with the accompanying drawings, which show for purposes of illustration only, an embodiment constructed in accordance with the present invention.

DETAILED DESCRIPTION OF THE DRAWINGS

Figure 1:
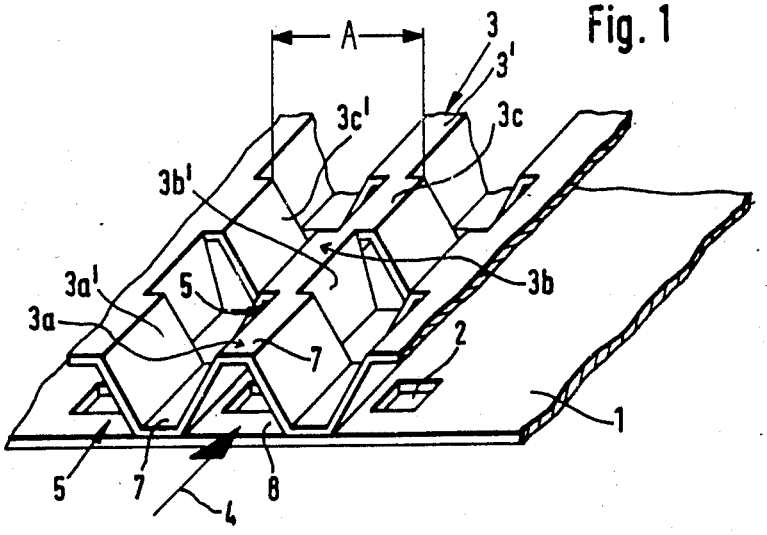
FIG. 1 is a perspective, partial view of two metal foils used in a preferred embodiment of the present invention.

FIG. 1 shows a flat metal foil 1 which, in a preferred embodiment, is made of a thin sheet steel. This metal foil 1 is provided with openings 2 at certain intervals which may, for example, be punched in. While the shown openings 2 are rectangular, openings of a different shape, such as round openings, may also be used.

Bordering on the flat metal foil 1 is corrugated foil 3 that may be constructed of the same material as the flat metal foil 1. The corrugated metal foil 3 is a single continuous sheet metal strip which, for example, is led through a pair of rollers provided with projections and recesses so that pressed-out areas and notches as shown in FIG. 1 are created. Each corrugation 3' is comprised of a plurality of partial corrugated segments **3*a*, 3*b*, 3*c*, etc. arranged behind one another in flow direction 4 extending transversely to the flow direction 4. The partial corrugated segments 3*a*, 3*b*, 3*c*, etc. are identical to one another, but are staggered with respect to one another transversely to the flow direction by about one fourth of the width A of the corrugation. This results in flow duct segments 5 of the same length in flow direction 4 which are staggered with respect to one another such that their walls 3*a'*, 3*b'*, 3*c'* which extend diagonally downward are located approximately in the center of either the preceding or the following flow duct segment 5. In the assembled carrier matrix the exhaust gas flowing in the direction of arrow 4 will always encounter flow resistances due to the staggered segments 3***a*, 3*b*, 3*c*. This causes the exhaust gas to be deflected in its flow direction 4 such that the turbulence of the gas flowing through and therefore also the effectiveness of the matrix is increased.

Figure 2:
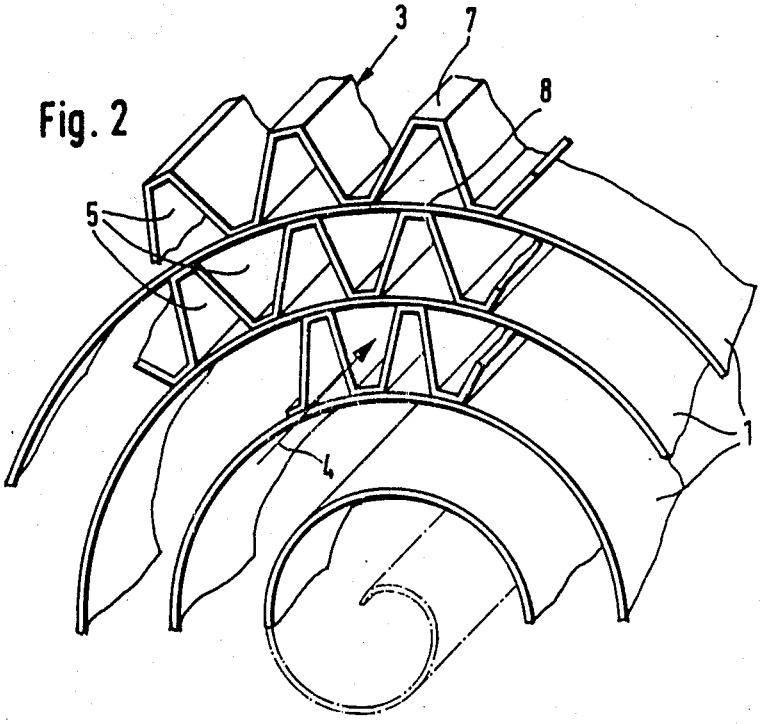
FIG. 2 is a schematic representation of a preferred embodiment of the present invention using the two metal foils of FIG. 1.

FIG. 2 shows that both sides of each corrugated foil 3 after a winding process is enclosed by a flat foil 1, thereby forming the flow ducts 5. The flow ducts 5 of bordering layers or windings are connected to one another by the openings 2.

As shown in FIGS. 1 and 2, the corrugated segments 3*a*, 3*b*, 3*c* which are firmly connected together each have a trapezoidal cross-section. The smaller side 7 of the trapezoid in each segment forms the closed part of the corrugated foil 3, while the larger side 8 of the two parallel sides of the trapezoid forms the open side of the corrugated foil 3. As a result, crowns are created at the side 7 of the trapezoid which are securely supported downward by diagonal walls. The crowns, since they are connected with the adjacent crowns of the bordering corrugated segments in one piece, cause the corrugated foil 3 to have considerable stability. The result is that the flat foil 1 and the corrugated foil 3 are especially well suited for the making of a carrier matrix by winding, as shown in the embodiment of FIG. 2. The flat metal foil 1 absorbs the tensile force to be applied during the winding, while the pressing together in an undesirable manner of the corrugated foil 3 disposed between two flat foils 1 is avoided due to the considerable stability of the corrugated foil 3. A wound carrier matrix can be made in an especially simple manner with the two foils shown in FIG. 1. Subsequently, it can be soldered in a known manner and then coated with catalyst material. The wound foils, before the soldering process, are pushed into a tube-shaped housing with a circular or oval cross-section in a known manner. Rectangular carrier bodies can also be formed by the layering of the foils shown in FIG. 1.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A carrier matrix, in particular for a catalytic reactor for the purification of the exhaust gas of internal combustion engines, comprising:

a flat foil;

a corrugated foil, said flat foil and said corrugated foil arranged in alternating layers;

said corrugated foil having a plurality of corrugations, each said corrugation having a plurality of segments fluidly connected behind one another in air flow direction, and transversely staggered to each other with respect to said air flow direction.

2. A carrier matrix according to claim 1, wherein said corrugated foil has a plurality of crowns and said flat foil contacts said crowns.

3. The carrier matrix according to claim 1, wherein said flat foil has a plurality of openings.

4. The carrier matrix according to claim 2, wherein said segments have a trapezoidal cross-section, with the smaller of the two parallel sides of said trapezoid forming said crowns, and the larger sides forming the open sides of said corrugations.

5. A carrier matrix according to claim 4, wherein said segments of a corrugation are of unitary construction.

6. A carrier matrix according to claim 1, wherein said flat foil and said corrugated foil are metal.

7. A carrier matrix according to claim 1, wherein said flat foil and said corrugated foil are wound in layers.

8. A carrier matrix according to claim 1, wherein said flat foil and said corrugated foil are folded into layers.

* * * * *